United States Patent [19]

Moriguchi et al.

[11] Patent Number: 5,039,910

[45] Date of Patent: Aug. 13, 1991

[54] STANDING-WAVE ACCELERATING STRUCTURE WITH DIFFERENT DIAMETER BORES IN BUNCHING AND REGULAR CAVITY SECTIONS

[75] Inventors: Yusuke Moriguchi; Hiroshi Kikuchi, both of Hyogo, Japan

[73] Assignee: Mitsubishi Denki Kabushiki Kaisha, Tokyo, Japan

[21] Appl. No.: 196,255

[22] Filed: May 20, 1988

[30] Foreign Application Priority Data

May 22, 1987 [JP] Japan ..... 62-125286
Oct. 12, 1987 [JP] Japan ..... 62-154647[U]
Oct. 20, 1987 [JP] Japan ..... 62-262597

[51] Int. Cl.[5] ..... H05H 9/04

[52] U.S. Cl. ..... 315/5.41; 315/5.42; 328/233; 313/360.1

[58] Field of Search ..... 315/5.39, 5.41, 5.42, 315/5.16, 5.27, 5.34; 313/360.1; 328/233; 376/108

[56] References Cited

U.S. PATENT DOCUMENTS 3,319,109 5/1967 Haimson ..... 315/5.41
3,436,588 4/1969 Hechtel ..... 315/5.34 X
4,162,423 7/1979 Tran ..... 315/5.41
4,286,192 8/1981 Tanabe et al. ..... 315/5.41
4,382,208 5/1983 Meddaugh et al. ..... 315/5.42 X
4,400,650 8/1983 Giebeler, Jr. ..... 315/5.41
4,401,918 8/1983 Maschke ..... 315/5.34
4,629,938 12/1986 Whitham ..... 315/5.41
4,746,839 5/1988 Kazusa et al. ..... 315/5.41

OTHER PUBLICATIONS

North-Holland Publishing Company-Amsterdam, edited by Lapostolle et al., "Linear Accelerators", 1970, pp. 606-616.

*Primary Examiner*—Eugene R. LaRoche
*Assistant Examiner*—Benny T. Lee
*Attorney, Agent, or Firm*—Rothwell, Figg, Ernst & Kurz

[57] ABSTRACT

A standing-wave accelerating structure for accelerating charged particles wherein a converging force and a diverging force of an electric field to an electron beam are checked to improve the transmittivity of the electron beam through the accelerating structure and production of X-ray leakage is eliminated or minimized. The accelerating structure comprises a buncher section including at least one cavity for mainly bunching charged particles, and a regular section including at least one cavity. The diameter of a bore in the buncher section is smaller than the diameter of another bore in the regular section. A shorting bar for stopping propagation of microwaves is inserted in at least one of the cavities, and a means for accelerating the charged particles and for converging a beam is provided forwardly or rearwardly of the cavity in which the shorting bar is inserted.

6 Claims, 5 Drawing Sheets

STANDING-WAVE ACCELERATING STRUCTURE WITH DIFFERENT DIAMETER BORES IN BUNCHING AND REGULAR CAVITY SECTIONS

BACKGROUND OF THE INVENTION

1. Field of the Invention

This invention relates to a standing-wave accelerating structure for accelerating charged particles such as electrons from an emitted energy to a higher energy with an electric field of microwave power.

FIG. 1 shows an exemplary one of standing-wave accelerating structure which is disclosed in "Linear Accelerator", p. 607, edited by P. M. Lapostolle and A. L. Septier, published by North-Holland Publishing Company, Amsterdam. Referring to FIG. 1, a beam 2 of charged particles is accelerated and advances in a standing-wave accelerating structure 1. Here, the charged particle beam 2 is a beam of electrons and advances in the direction indicated by an arrow mark of a broken line. Accelerating cavities 3 are provided to provide energy to the electron beam 2 by way of microwave power to accelerate the electron beam 2. Coupling cavities 4 act to cause matching of the phases of microwaves of adjacent ones of the accelerating cavities 3 so that the electron beam 2 may be acted upon by an electric field in the accelerating direction in each of the accelerating cavities 3 as the electron beam 2 advances to one after another of the accelerating cavities 3.

FIG. 2 shows a cross section of the arrangement of FIG. 1. Referring to FIG. 2, shadowed portions of the accelerating structure 1 are made of a metal of a high electric conductivity such as, for example, copper and define therein the accelerating cavities 3 and the coupled cavities 4. It is to be noted that all of the shadowed portions of the accelerating structure 1 need not be made of the same material in accordance with the frequencies of the microwaves which resonate in the cavities and only those portions of the accelerating structure 1 which are sufficiently thick with respect to the skin depth by the microwaves from a surface of a cavity need be made of a material of a high electric conductivity. A pair of flanges 5*a* and 5*b* are provided to allow connection of the accelerating structure 1 to another device, and the inlet or entrance flange 5*a* is provided on one side of the accelerating structure 1 through which the electron beam 2 comes into the accelerating structure 1 while the outlet or exit flange 5*b* is provided on the other or exit side of the accelerating structure 1. A wave guide 6 is coupled to the accelerating structure 1 for introducing microwaves into the individual cavities. The wave guide 6 has coupling holes formed therein and coupling holes 7*a* formed between the cavities such that the microwaves may be distributed into the individual cavities through the coupling holes 7*a* and 7*b*. The coupling holes 7*a* are provided between the accelerating cavities 3 and the coupled cavities 4 while the coupling holes 7*b* are provided between the wave guide 6 and the accelerating cavities 3. Each of the accelerating cavities is a certain modification from a cavity of the re-entrant type, and each of a pair of projected portions 8 for intensely concentrating an electric field is called, in a standing-wave accelerating structure, a nose cone. A bore 9 for passing the electron beam 2 therethrough is formed in each of pairs of the opposing nose cones 8 so that the electron beam 2 may be successively accelerated in the accelerating cavities 3 by electric fields of microwaves produced by the nose cones 8.

As seen in FIG. 2, the accelerating structure 1 has a repetitive or cyclic structure of the accelerating cavities 3 and the coupled cavities 4 and thus has a spatial periodicity. The cycle distance 21*a* between the centers of adjacent chambers 3 is the same dimension as and is normally indicated as the 21*b* distance because the right-hand side half and the left-hand side half of each of the cavities are symmetrical and always have a same dimension, and the dimension is called a cycle and is referred to herein as D. A section 22 of the accelerating structure 1 in which the cycle 21*b* has a constant value so that the electron beam 2 may always be acted upon by accelerating electric fields in the individual accelerating cavities 3 when the velocity of the electron beam 2 substantially reaches the light velocity is called a regular section. To the contrary, another section 23 of the accelerating structure 1 in which the electron beam 2 after coming into the accelerating structure 1 is accelerated by microwaves and electrons are bunched to a location in which the microwaves are efficient for the velocity modulation of the electron beam 2 is called a buncher section. In FIG. 2, the buncher section 23 includes two cavities, but this is a mere example and the buncher section 23 may otherwise include a greater or smaller number of cavities depending upon a design of the accelerating structure.

FIG. 3 shows detailed construction of such an accelerating cavity. Referring to FIG. 3, the dimension 24 of the diameter of the bore 9 is represented by b, the dimension 25 called height of the nose cones 8 by h, and the gap 26 between the opposing nose cones 8 by g. Arrow marks 30 indicate an electric field produced by microwaves within the accelerating cavity 3. FIG. 3 illustrates, in diagrammatic representation, a manner in which the electron beam 2 is accelerated. Since naturally the electric field 30 is an electric field produced by microwaves, the intensity and the direction vary in a cyclic manner in time.

Now, operation will be described. As shown in FIGS. 1 and 2, microwaves of such a high power of, for example, 5 MW in peak power of pulses are supplied to the accelerating structure 1 from the wave guide 6. It is to be noted that such microwaves are supplied by a high power microwave tube such as a klystron or a magnetron not shown. The microwaves propagate into the coupling holes 7*b* and then into the entire structure 1 through the coupling holes 7*a* to standing waves in each of the cavities. This is why the accelerating structure 1 is called structure of the standing wave type. As the accelerating structure 1 is designed such that the Q value of the cavities is set high while the Q value of coupled cavity 4 is set low, the energy of the microwaves is stored more in the accelerating cavities 3 that the electron beam 2 is accelerated with a high efficiency The electron beam 2 is introduced into the accelerating structure 1 from a suitable device such as electron gun connected to the inlet flange 5*a* and is then accelerated in the buncher section 23 (increased in velocity and in energy) while being bunched a certain phase of the microwaves until the velocity the electron beam 2 is increased substantially the light velocity. After this, the electron beam 2 advances to the regular section 22 in which the energy thereof is increased while maintaining the almost light velocity (naturally, in a strict sense, a velocity lower than the light velocity) in accordance with the relatively theories, and then the electron beam 2 advances into a next device such as, for example, a beam which is connected to the outlet flange 5*b* of the structure 1.

Acceleration of the electron beam 2 will now be described with reference to FIG. 3. When the electron beam 2 comes into the accelerating cavity 3 through the bore 9, an electric field 30 is produced between the opposing nose cones 8 in the cavity 3. The direction of the arrow marks indicates a direction in electrons are accelerated. If the microwaves change by a half wavelength distance in the accelerating direction while the electron beam 2 travels in the accelerating cavity 3 of the cycle 21*b*, the electron beam 2 only experiences the accelerating electric field produced in gap 26 during passing thereof through the cycle and also in the subsequent next accelerating cavity, the electron beam 2 is similarly acted upon by another accelerating electric field of microwaves. In this manner, the electron beam 2 is accelerated successively. Thus, the adjacent accelerating cavities are designed such that microwaves in each two adjacent ones thereof are different by $\pi$ in phase, that is, by a half wavelength distance.

The electric field 30 presents a shape an arc near the locus of the electron beam 2 as in FIG. 3 and thus concentrates on an edge of the bore 9 because the bore 9 is a space. The electron beam 2 which has a limited broadening advances in the accelerating structure 1 while repeating convergence and divergence by the arcuate electric fields 30 when the electron beam 2 advances in the electric fields 30. While it may often be considered from the shape shown in FIG. 3 that the diameter of the electron beam 2 does not dive very much and has convergency because the electron beam 2 coming in with a low energy has a converging force with a component of the electric field in the converging direction and is provided with a high energy by an action of the electric field whereafter it acted upon by a diverging force and advances to a next accelerating cavity, the electron beam 2 is separated portions which undergo a high convergence and a high divergence depending upon a relationship between the position of the electron beam 2 in the advancing in the cavity and the phase of microwaves.

All of the accelerating cavities 3 must coincide with each other in resonance frequency within an allowance. Since the velocity of electron is not sufficiently high in the buncher section 23 of the accelerating structure 1 compared with that in the regular section 22, the cycle 21*b* is designed to be short. In this instance, the resonance frequency is dominantly defined by a capacitance component C of the opposing nose cone portions and an inductance component L around the opposing nose cone portions assumes a value near to $1/\sqrt{CL}$. Therefore, the accelerating cavities 3 are designed such that the gap 26 is reduced without changing the height (shown by dimension 25) of the nose cones irrespective of the buncher section and the regular section 22. This is because, while the capacitance component C of the gap portion increases, the inductance component L decreases since the cross section of the cavity decreases as shown in FIG. 3 and consequently $1/\sqrt{CL}$ does not exhibit a considerable change.

Since the conventional standing-wave accelerating structure has such a construction as described above, while there is a diverging portion in an electron beam depending upon a shape of an electric field, in the buncher section of the accelerating structure, the gap between opposing nose cones is reduced and the arcuate shape of the electric field on an electron beam passing line becomes further prominent (FIG. 4) so that the converging and diverging forces to the electron beam increase. Consequently, there are various problems that the transmittivity of an electron beam through the accelerating structure may be deteriorated, that electrons may collide with a wall of the accelerating structure to produce unnecessary radiations such as X rays, and that the improvement in accelerating characteristic of an electron beam cannot be anticipated.

Meanwhile, another exemplary one of conventional standing-wave accelerating structure which have similar functions to those of the standing-wave accelerating structure described above is shown in FIG. 5. The standing-wave accelerating structure shown includes coupled cavities 52*a* to 52*d*, 53 and 54, and shorting bars 55 for stopping propagation of microwaves. Thus, particles 56 are accelerated by energy of microwaves accumulated in accelerating cavities 51 and pass through bores 57.

Subsequently, operation will be described. The coupled cavities 53 and 54 which are provided with the shorting bars have coupling holes of different sizes. In particular, the size of the coupling hole of the coupled cavity 53 is equal to the size of the coupling holes of the coupled cavities for the other accelerating cavities 51 while the coupling hole of the coupled cavity 54 is smaller than any other coupling hole.

Now, if the shorting bar 55 is inserted into the coupled cavity 54 as shown in FIG. 6, microwaves will propagate in the coupled cavity 53 as indicated by an arrow mark Al so that the microwaves are caused to propagate in the second and following coupled cavities 52*d*.

To the contrary, if the shorting bar 55 is inserted into the coupled cavity 53 as shown in FIG. 7, microwaves will propagate in the coupled cavity 54 as indicated by an arrow mark A2 so that the microwaves are caused to propagate in the following coupled cavities 52*d*.

In the meantime, if the shorting bars 55 are inserted into both of the coupled cavities 53 and 54 as shown in FIG. 8, microwaves will not propagate at all in the following coupled cavities 52*d* as indicatd by an arrow mark A3.

As a result, electric field distributions in the accelerating structure will be such as shown in FIGS. 9(*a*) to 9(*c*) in which the electric field distributions of the cases of FIGS. 6 to 8 are shown, respectively. Since particles 56 accelerated are supplied with different amounts of energy by the electric fields within the accelerating structure, energy of the particles 56 is different in the cases of FIGS. 9(*a*) to 9(*c*).

The energy of the accelerated particles 56 is adjusted in this manner by insertion or removal of the short bar or bars 55.

Since the latter conventional standing-wave accelerating structure has such a construction as described above, if the shorting bar or bars 55 are inserted to reduce or eliminate the magnitude of the electric fields of the second and following cavities, also the electric field perpendicular to the direction of advancement of the particles 56 is reduced or eliminated. Consequently, there is a drawback that the particles 56 will diverge in the coupled cavities following the shorting bar and bars and accordingly it is necessary to apply a magnetic field from outside of the accelerating structure to cause the particles 56 to converge.

The conventional standing-wave accelerating structure has another drawback that, since the bores through which electrons pass have a fixed diameter for all of the accelerating cavities, sufficiently accelerated particles may collide with cavity walls of the rear half of the accelerating structure to produce X-ray leakage of a high energy or the diameter of a beam at the exit of the accelerating structure is widened.

SUMMARY OF THE INVENTION

It is a first object of the present invention to provide a standing-wave accelerating structure wherein the transmittivity of an electron beam through the accelerating structure is improved and production of unnecessary radiations from the accelerating structure can be controlled.

It is second object of the present invention to provide a standing-wave accelerating structure wherein particles can be converged without applying a magnetic field from outside.

It is a third object of the present invention to provide an accelerating structure wherein production of X-ray leakage of a high energy by collision of particles of a high energy with cavity walls of the accelerating structure can be prevented and the diameter of a beam to be delivered from the accelerating structure can be reduced.

In order to attain the first object described above, a standing-wave accelerating structure according to a first embodiment of the present invention is constituted such that the diameter of a bore of a cavity of a buncher section thereof is formed smaller than the diameter of a bore in a regular section thereof in order to improve the shape of electric fields for acceleration.

Accordingly, diverging components of an electron beam in directions perpendicular to the direction of movement of the electron beam are reduced to improve the transmittivity of an electron beam through the accelerating structure.

Further, in order to attain the second object described above, a standing-wave accelerating structure according to a second embodiment of the present invention comprises an accelerating and beam converging means provided forwardly or rearwardly of a coupled cavity provided with a shorting bar for accelerating particles and for providing a beam converging action.

The accelerating and converging means expands, in the accelerating cavity for which the accelerating and converging means is provided, the electric field distribution in directions perpendicular to the direction of advancement of particles to accelerated the particles and apply a converging action to the particles.

In order to attain the third object described above, a standing-wave accelerating structure according to a third embodiment of the present invention comprises a ring provided in the diameter of a bore of an accelerating cavity of the accelerating structure. Accordingly, a beam which is expanded farther than the inner diameter of the ring is cut by the ring provided in the cavity of the accelerating structure.

DETAILED DESCRIPTION OF THE PREFERRED EMBODIMENTS

Figure 10:
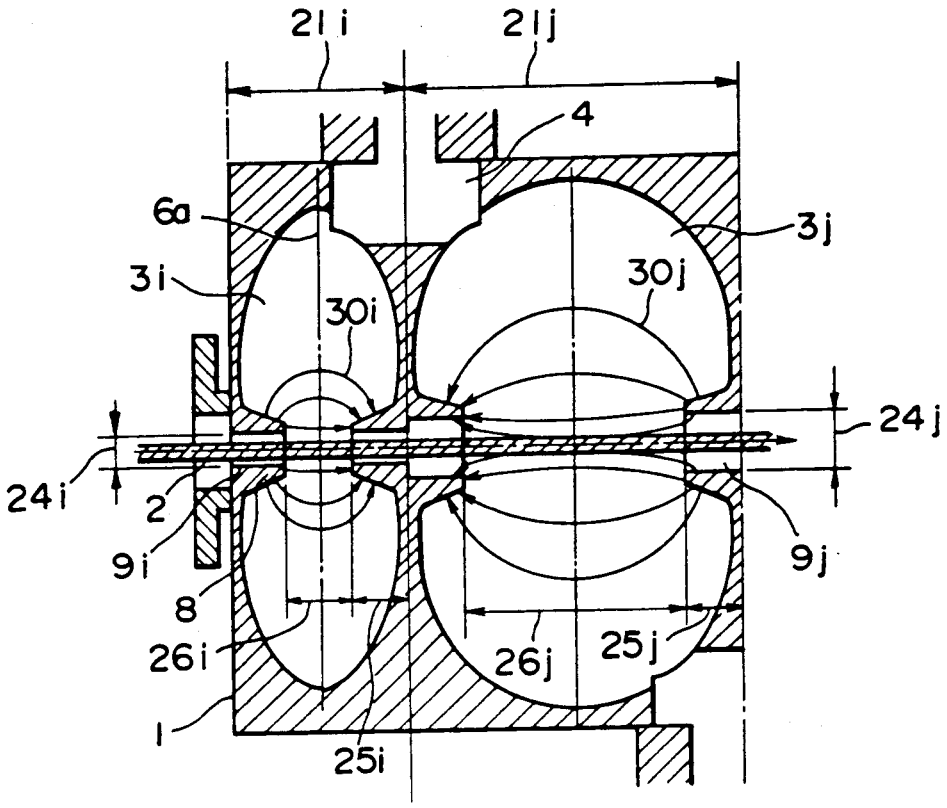
FIG. 10 is a vertical sectional view of essential part of a standing-wave accelerating structure showing a first embodiment of the present invention.
Figure 11:
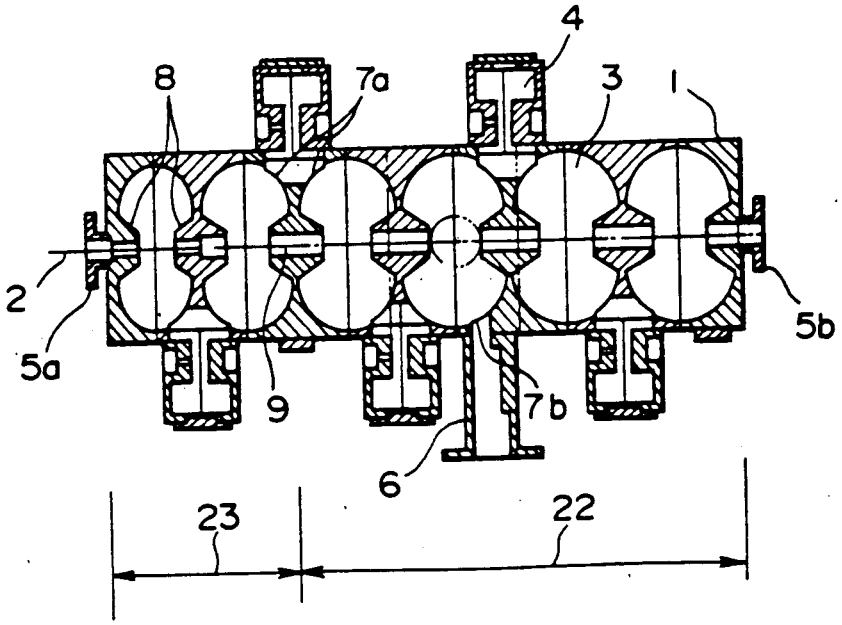
FIG. 11 is a vertical sectional view of the accelerating structure of FIG. 10.

Now, a first embodiment of the present invention will be described with reference to FIGS. 10 and 11. It is to be noted that the present embodiment attains the first object of the present invention described hereinabove. An accelerating structure 1 includes a plurality of cavities, and the suffix i is added to reference numerals to various elements as an indicium indicating a shape or the like peculiar to the first cavity which is first met by an electron beam 2 introduced into the accelerating structure 1 while the suffix j is added to reference numerals to various elements as another indicium indicating a shape or the like peculiar to the second or following cavities. Thus, the first and following cavities are denoted by reference symbols 3*i* and 3*j*, respectively; bores are denoted by 9*i* and 9*j*; cycles of the cavities by 21*i* and 21*j*; diameters of the bores by 24*i* and 24*j*; and electric fields produced by opposing nose cones in the accelerating cavities by 30*i* and 30*j*. The location at which the bores 9*i* and 9*j* change to the diameters 24*i* and 24*j*, respectively, is the center between the first and second cavities, that is, the boundary between the cavity cycles 21*i* and 21*j*.

The velocity of the electron beam 2 which comes into the accelerating structure 1 is very low compared with light velocity. For example, when the energy of injected electrons is 20 keV, the velocity is 0.272 C (C is the light velocity) or so, and when the energy of injected electrons is 60 keV, the velocity is 0.446 C or so. It is to be noted that since the velocity of electrons is 0.941 C and 0.989 C when the electron energy is 1 MeV and 3 MeV, respectively, it may be considered that the velocity of electrons is substantially constant in a regular section 22 of the accelerating structure 1. Since the velocity of electrons in the first cavity 3*i* is not raised to a velocity near light velocity, normally the cycle 21*i* is designed to be short comparing with the cycle 21*j*. As described hereinabove, designing to reduce cycle 21*i* is normally attained by reduction of the gap 26*i* while the gap in chamber 3*j* is denoted by 26*j*. Meanwhile, the cycle and the gap in the regular section 22 of the accelerating structure 1 are denoted by 21*b* and 21*c*, respectively (the cycle 21*j* and the gap 26*j* should be denoted as indicated if they are in the regular section 22, but the second cavity 3*j* may otherwise be in the buncher section, and the cycle and the gap would be denoted accordingly. Where the accelerating structure 1 is designed with Di/Dr=0.6 or so where Di is the cycle distance 21*i* and Dr is the cycle distance 21*b*, the ratio gi/gr will have a value of gi/gr=0.3 where gi is the gap 26*i* and gr is the gap 21*c*, because normally the height 25 of the nose cones is not varied, and the electric field 30*i* will have a shape wherein the intersecting angle with the locus of an electron beam is large comparing with that in the regular section 22. Thus, where the bore diameter at chamber 3*i* is denoted by 24*i* and the bore diameter in the regular section 22 is denoted by 24*j*, the accelerating structure 1 is designed such that, by making the dimension 24*i* smaller than 24*j* as seen in FIG. 10, a similar intersecting angle to that in the regular section 22 may be provided by the locus of an electron beam and the electric field.

Since the bore 9 is a hole through which the electron beam 2 passes,, it will make no sense if the bore diameter 24*i* of the first cavity 3*i* is smaller than the diameter of the electron beam 2. While the diameter of an injected electron beam is 1 mm or so in the case of a well-designed electron gun, in some cases electron current of 0.5 to 1 A in peak current may be required, and accordingly it is a normal design that the diameter of an injected electron beam is assumed to be 2 to 3 mm. The bore diameter of the bore in the regular section 22 of the accelerating structure 1 is a parameter related to the energy gain efficiency and the beam transmittivity of the electron beam 2 in the accelerating structure 1, and with the above described divergence of the electron beam 2 taken into consideration, the bore diameter of the bore 9 in the regular section 22 is set, as a design example in the S band, to 5 to 7 mm or so where there is a focusing coil around the accelerating structure 1 and to 8 to 11 mm where there is no focusing coil. Thus, the bore diameter of the first cavity 3*i* and the cycle of the cavity are selected so as to make a substantially same ratio, that is, bi/br=Di/Dr.

With the construction described above, the electric field 30*i* in the first cavity 3*i* is approximately equivalent to an electric field in the regular section 22 of the accelerating structure 1, and divergence of an electron beam in the first cavity 3*i* can be checked. Normally, since the bore diameter bi of the first cavity 3*i* does not become extremely small and the intersecting angle of the electron beam 2 with the electric field 30*i* becomes equivalent to that in the regular section 22 without interfering with passage of the electron beam 2, the electron beam 2 is not acted upon by a great diverging force and accordingly the electron beam transmittivity of the accelerating structure 1 is improved.

It is to be noted that in the first embodiment described above an example wherein the bore diameter of only the first cavity is reduced is shown. Where there is a buncher also in the following cavity or cavities, normally the cycle distance of the second or following cavities is not made as small as that of the first cavity compared with the cycle distance in the regular section. However, an alternative construction may be employed wherein the cavities are changed successively in bore diameter with the setting of bj/br=Dj/Dr (bj and Dj denote the bore diameter of the bores 9*b* the cycle 23*a*, respectively, of the individual cavities in the buncher section) similarly to bi/br =Di/Dr.

Subsequently, as a modified form, the bore diameter of the first cavity 3*i* and the gap between the opposing nose cones of the cavity are selected to be substantially in the same ratio within a range wherein the bore diameter is not smaller than the diameter of a beam. In particular, by the setting of bi/br= and the setting of bj/br=gj/gr, . . . for the successive cavities in the buncher section of the accelerating structure 1, the electric fields 30*i*, 30*j*, . . . in the cavities in the buncher section 23 become approximately equivalent to the electric field in the regular section 22, and convergence of the electron beam 2 in the buncher section 23 can be checked.

If the bore diameter 24*i* of the first cavity 3*i* is decreased extremely so that passage of the electron beam 2 is hindered, it is necessary to set the bore diameter bi to a rather greater diameter than such a diameter of the electron beam 2 as described hereinabove. However, if the ratios in bore diameter and in gap between opposing nose cones are set to substantially same ratios between the buncher section 23 and the regular section 22 the electric fields will have similar shapes. Accordingly, the electron beam 2 is not acted upon by a great converging force in the buncher section 23 and the electron beam transmittivity of the accelerating structure 1 is improved.

Further, even if the second cavity or the second and following cavities are in the buncher section 23 of the accelerating structure 1, the cycle distance of the following cavity or cavities is not made so small as that of the first cavity 3*i* compared with the cycle 21*b* in the regular section 22. In other words, since normally the gap distance in the second and following cavities is not so small as that of the first cavity compared with the gap gr in the regular section 22, another construction may be employed wherein only the bore diameter of only the first cavity 3*i* is set to bi/br=gi/gr where these terms have been defined earlier and the bore diameter is set to br for all of the second and following cavities.

As described so far, according to the first embodiment of the present invention, the bore diameter in the buncher section of the accelerating structure is set small compared with the bore diameter in the regular section of the accelerating structure so as to reduce the intersecting angle of an electron beam to an electric field of microwaves. Accordingly, divergence of the electron beam can be reduced, and consequently the electron beam transmittivity of the accelerating structure can be improved while production of unnecessary radiant rays by collision of a diverged electron beam with a wall of the accelerating structure can be checked. Thus, there is an effect that reduction of the capacity of power and reduction in cost of a pulse modulator as an accelerator, reduction in cost and weight by reduction of a radiant ray shield around the accelerating structure and so on, can be attained.

Subsequently, a second embodiment of the present invention will be described with reference to FIGS. 12(*a*) and 12(*b*) to 14. The second embodiment attains the second object of the present invention.

Figure 12:
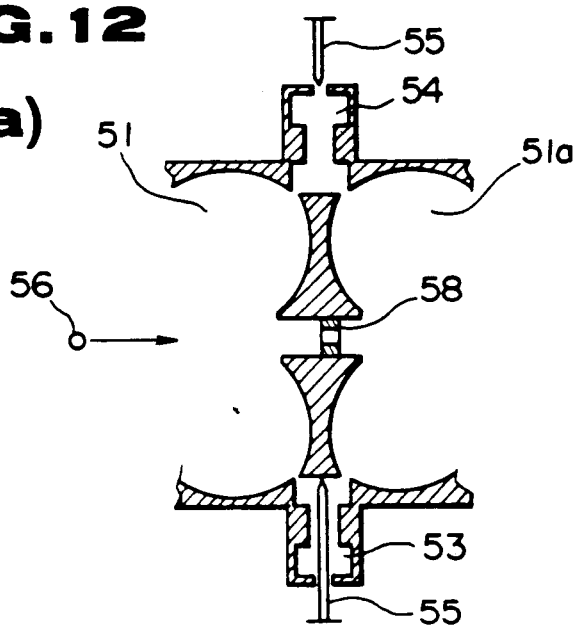
FIG. 12(*a*) is a cross sectional view showing a construction of an essential part of a standing-wave accelerating structure according to a second embodiment of the present invention, and FIG. 12(*b*) is a plan view of a ring used in the accelerating structure of FIG. 12(*a*)
Figure 12:
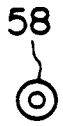

In FIG. 12(*a*), like parts are denoted by like reference numerals to those of FIG. 5, and overlapping description thereof is omitted herein while description will be given mainly of portions differing from the arrangement of FIG. 5.

Figure 1:
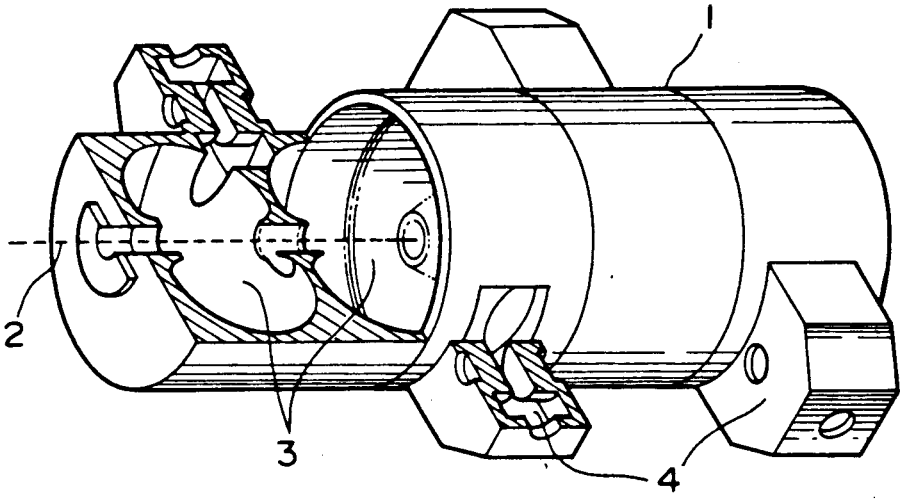
FIG. 1 (PRIOR ART)
FIG. 1 is a perspective view, partly broken away, showing a conventional standing-wave accelerating structure.
Figure 2:
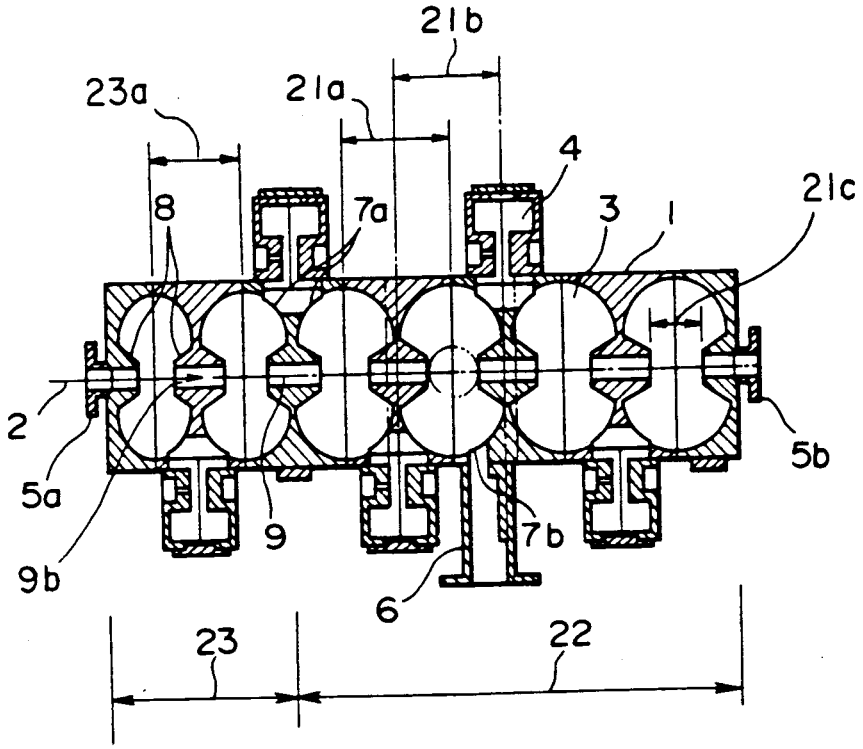
FIG. 2 (PRIOR ART)
FIG. 2 is a vertical sectional view of the accelerating structure of FIG. 1.
Figure 3:
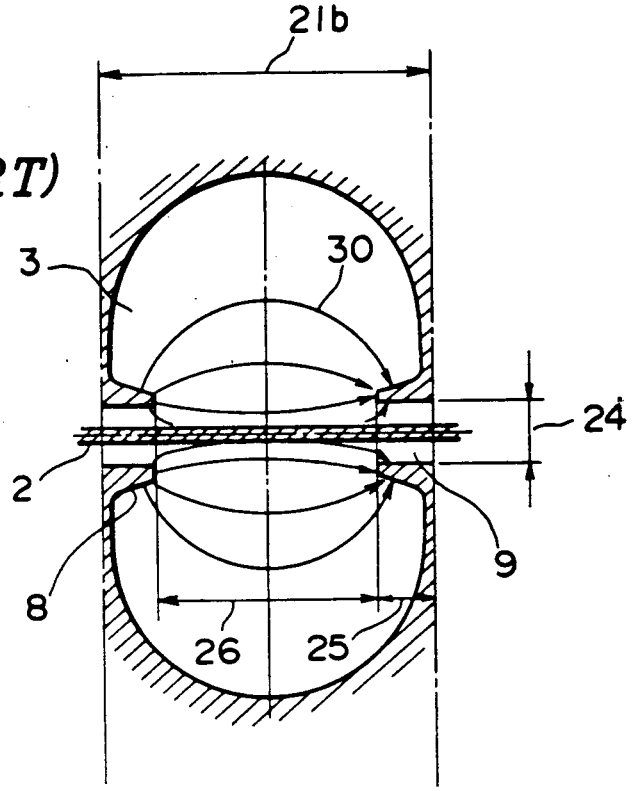
FIG. 3 (PRIOR ART)
FIGS. 3 and 4 are partial vertical sectional views illustrating operations of the accelerating structure of FIG. 1.
Figure 4:
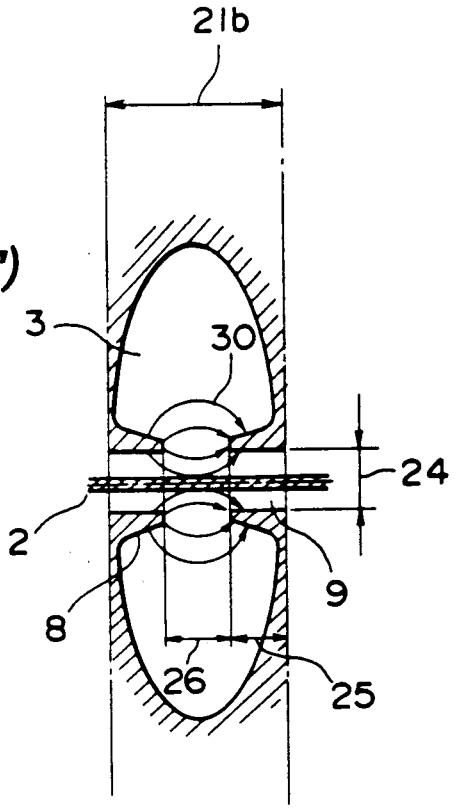
FIG. 4 (PRIOR ART)
Figure 5:
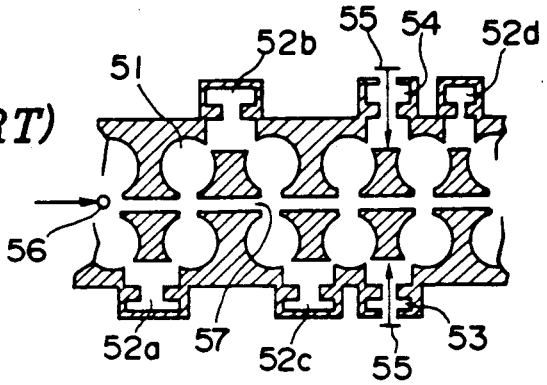
FIG. 5 (PRIOR ART)
FIG. 5 is a cross sectional view showing a construction of essential part of another conventional standing-wave accelerating structure.

As apparent from comparison of FIG. 12(*a*) with FIG. 5, elements denoted by reference numerals 51 and 53 to 56 are similar to those of FIG. 5, and in the embodiment of FIG. 12(*a*), a ring 58 is provided as an accelerating and beam converging means in an accelerating structure 1 at an entrance of an accelerating cavity 51*a* subsequent to a coupled cavity 53 in which a short bar 55 is inserted. The ring 58 has such a shape as shown in FIG. 12(*b*) and is provided to change the distribution of an electric field in the accelerating cavity 51*a*. The ring 58 is disposed at a location spaced by several millimeters from the particle entrance of the accelerating cavity 51*a*. Construction of the other portion of the accelerating structure 1 is similar to that of the arrangement of FIG. 5.

Figure 13:
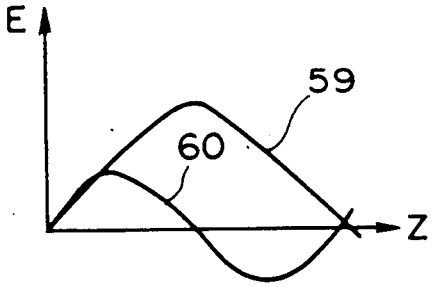
FIGS. 13 and 14 are graphs illustrating electric field distributions in the accelerating cavity of the accelerating structure of FIG. 12(*a*)
Figure 14:
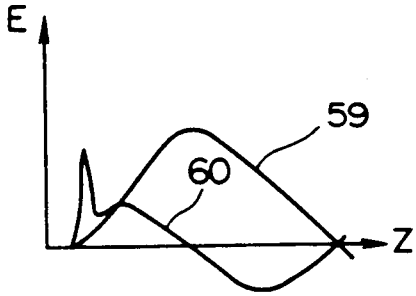

FIGS. 13 and 14 illustrate electric field distributions in the accelerating cavity 51. Reference numeral 59 in FIGS. 13 and 14 denotes the intensity of an electric field in the advancing direction of particles 56 in the accelerating cavity 51 while reference 60 denotes the intensity of the electric field in a direction perpendicular to the advancing direction of the particles 56.

Subsequently, operation will be described. While the basic operation is similar to that of the conventional arrangements, the ring 58 is placed at the entrance of the accelerating cavity 51*a* subsequent to the coupled cavity 53 provided with the shorting bar as shown in FIG. 12(*a*). The electric field distribution in the accelerating cavity 51*a* is different from the electric field distribution in the other accelerating cavities 51 (FIG. 13), and the electric field perpendicular to the advancing direction of the particles 56 increases suddenly near the particle entrance of the accelerating cavity 51*a* so that a high converging action acts upon the particles 56 as shown in FIG. 14.

Figure 9:
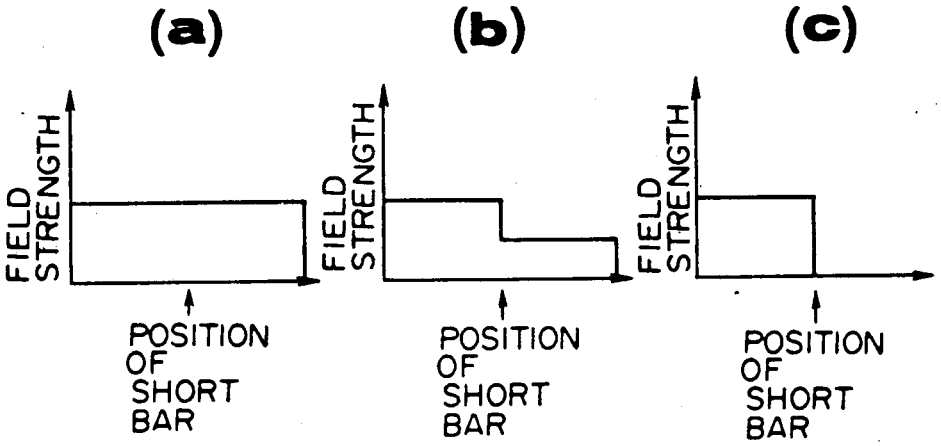
FIG. 9 (PRIOR ART)
FIGS. 9(*a*), 9(*b*) and 9(*c*) are graphs illustrating electric field intensities in the standing-wave accelerating structure when the shorting bar or bars are inserted into the different coupled cavities as shown in FIGS. 6 to 8, respectively.

Accordingly, even if the shorting bar 55 is inserted into the coupled cavity 53 of FIG. 5 and consequently the electric field suddenly becomes weak in the accelerating cavity 51*a* of FIG. 12(*a*) as shown in FIG. 9(*a*), the particles 56 are accelerated without being diverged because they are acted upon by a high converging action at the entrance of the accelerating cavity 51*a* .

Figure 8:
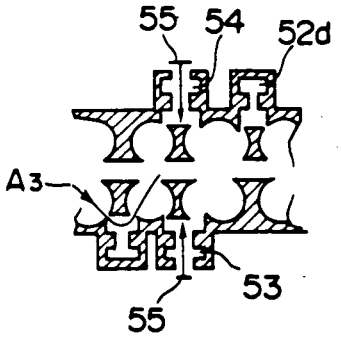
FIG. 8 (PRIOR ART)

It is to be noted that in case the shorting bars 55 are inserted into the coupled cavities 53 and 54 on the opposite sides as shown in FIG. 8, no electric field is produced in the cavities following the accelerating cavity 51*a* of FIG. 12(*a*) as seen in FIG. 9(*c*).

In such a case, the ring 58 may be provided at the entrance of the accelerating cavity 51 of FIG. 12(*a*). In other words, in case there are such three manners of insertion of the shorting bar or bars 55 as shown in FIGS. 6 to 8, it is necessary to provide the ring 58 at the entrance of each of the accelerating cavity 51 and the accelerating cavity 51*a* of FIG. 12(*a*).

Figure 6:
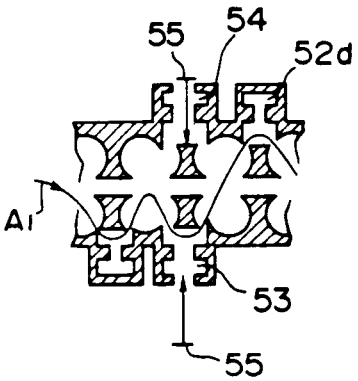
FIG. 6 (PRIOR ART)
FIGS. 6 to 8 are cross sectional views illustrating propagating conditions of microwaves when a shorting bar or bars are inserted into different coupled cavities of the standing-wave accelerating structure.
Figure 7:
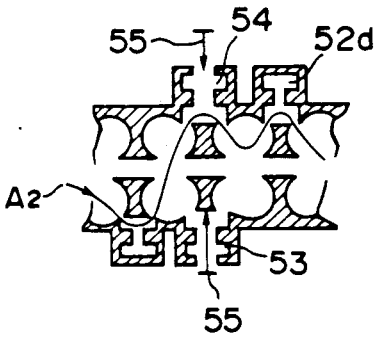
FIG. 7 (PRIOR ART)

It is to be noted that, in case the shorting bar 55 is to be inserted in such manners as shown in FIGS. 6 and 7, the ring 58 may be inserted at the entrance to the accelerating cavity 51*a*.

If such a ring 58 is provided at each of all of the accelerating cavities, the particles 56 will be strongly converged in any case at the entrance of each of the accelerating cavities.

As described so far, according to the second embodiment of the present invention, the accelerating and beam converging means is provided for an accelerating cavity forwardly or rearwardly of a coupled cavity which is provided with a shorting bar. Consequently, particles will not be diverged in any coupled cavity following the shorting bar, and accordingly there is no necessity of using an external magnetic field for converging such particles. Therefore, there is an effect that the accelerating structure can be made compact and produced at a reduced cost.

Figure 15:
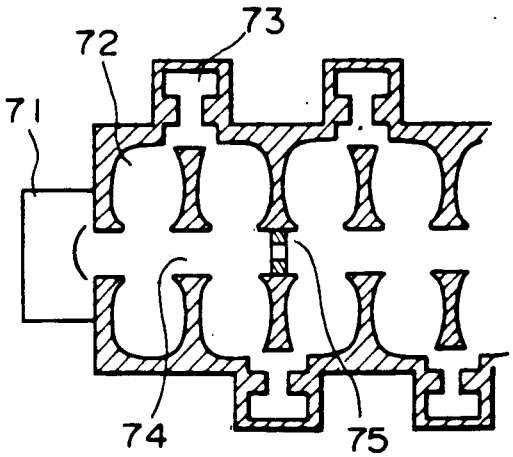
FIG. 15 is a vertical sectional view of a standing-wave accelerating structure showing a third embodiment of the present invention.

Subsequently, a third embodiment of the present invention will be described. The third embodiment realizes the third object of the present invention. The third embodiment is shown in FIG. 15. Referring to FIG. 15, reference numeral 71 denotes an electron gun, 72 an accelerating cavity, 73 a coupled cavity, 74 a bore diameter portion, and 75 a ring provided in the bore diameter of the second accelerating cavity 72 for limiting passage of a beam.

With the accelerating structure having the construction described above, a beam emitted from the electron gun 71 is accelerated in each of the cavities 72 of the accelerating structure while it undergoes divergence and convergence simultaneously with such acceleration. Here, since a diverging force is greater than a converging force, the diameter of the beam is expanded simultaneously with acceleration of the beam. However, a portion of the beam greater than the inner diameter of the ring 75 is cut by the ring 75 provided in the bore diameter portion 74 at the exit of the second cavity so that the beam is throttled to the diameter smaller than the inner diameter of the ring 75. It is to be noted that the beam energy is still 1 MeV or so at the second cavity so that, even if the beam collides with the ring, the intensity of X-ray leakage is very low.

As a result, the diameter of a beam forwarded from the accelerating structure is small and the intensity of X-ray leakage is so low that the quantity of shields can be reduced.

It is to be noted that while in the third embodiment described above the ring is provided in the bore diameter portion at the exit of the second cavity, it may otherwise be provided in the bore diameter portion of a cavity following the second cavity where the energy gain for one cavity is low.

As described so far, according to the third embodiment of the present invention, the ring is provided in the bore diameter portion. Accordingly, the diameter of an output beam of the accelerating structure is reduced and the intensity of X-ray leakage is low. Consequently, the quantity of shields is reduced and the accelerating structure is produced at a reduced cost.

What is claimed is:

1. A standing-wave accelerating structure for accelerating charged particles to a high energy using an electric field of microwaves, comprising a buncher section including at least one cavity for bunching charged particles, and a regular section coupled to said buncher section and including at least one cavity, said accelerating structure having a cylindrically shaped bore provided in each of the cavities of said accelerating structure for passing the charged particles therethrough along an axis through said bores, the diameter of the bore in said at least one cavity of said buncher section being smaller than the diameter of the bore in said at least one cavity of said regular section.

2. A standing-wave accelerating structure according to claim 1, wherein said regular section comprises a plurality of cavities respectively coupled to each other and the diameter of the bore in said at least one cavity of said buncher section wherein the charged particles coming into said accelerating structure and bunched for the first time has a smaller diameter than the other bores in said cavities of said regular section and said other bores all have a uniform diameter.

3. A standing-wave accelerating structure according to claim 1, wherein the diameter of the bore in said at least one cavity of said buncher section presents a substantially equal ratio with respect to the diameter of the bore in said at least one cavity of said regular section to the ratio of an axial length of a cavity cycle of said at least one cavity of said buncher section substantially in the direction of said axis of said accelerating structure with respect to an axial length of a cavity cycle of the at least one cavity in said regular section.

4. A standing-wave accelerating structure according to claim 1, wherein said buncher section and said regular section each comprises a plurality of cavities and the diameter of the bore of each of the cavities in said buncher section presents a substantially equal ratio with respect to the diameter of the bores of the cavities in said regular section to the ratio of an axial length of a cavity cycle of the cavities in said buncher section with respect to an axial length of a cavity cycle of the cavities in said regular section.

5. A standing-wave accelerating structure according to claim 1, wherein each of said at least one cavities in said buncher section and in said regular section include a gap defined between opposing nose cones facing each other therein and the diameter of the bore of said at least one cavity in said buncher section presents a substantially equal ratio with respect to the diameter of the bore of said at least one cavity in said regular section to the ratio of the length of the gap between the opposing nose cones of said at least one cavity in said buncher section with respect to the length of the gap between the pair of opposing nose cones of said at least one cavity in said regular section.

6. A standing-wave accelerating structure according to claim 1, wherein a ring for limiting passage of the charged particles therethrough is provided in said bore of said buncher section.

* * * * *